US006491477B2

(12) United States Patent
Bennett, Jr. et al.

(10) Patent No.: US 6,491,477 B2
(45) Date of Patent: Dec. 10, 2002

(54) SELF-ELEVATING DRILLING UNIT

(75) Inventors: William T. Bennett, Jr., Metairie, LA (US); Richard Roper, Mandeville, LA (US)

(73) Assignee: Bennett & Associates, LLC, New Orleans, LA (US)

( * ) Notice: Subject to any disclaimer, the term of this patent is extended or adjusted under 35 U.S.C. 154(b) by 0 days.

(21) Appl. No.: 09/844,387

(22) Filed: Apr. 27, 2001

(65) Prior Publication Data

US 2002/0159840 A1 Oct. 31, 2002

(51) Int. Cl.[7] ..... E04B 1/34; B36B 35/44
(52) U.S. Cl. ..... 405/201; 114/265
(58) Field of Search ..... 405/196, 201–206, 405/209; 175/5, 9; 52/73; 114/265

(56) References Cited

U.S. PATENT DOCUMENTS 1,128,039 A * 2/1915 Piercy ..... 405/201
3,477,235 A * 11/1969 Branham et al. ..... 405/201
4,103,503 A * 8/1978 Smith ..... 405/196
4,483,644 A * 11/1984 Johnson ..... 175/9
4,938,628 A * 7/1990 Ingle ..... 405/196
6,171,027 B1 1/2001 Blankestijin ..... 405/201

* cited by examiner

*Primary Examiner*—Robert E. Pezzuto
*Assistant Examiner*—Tara L. Mayo
(74) *Attorney, Agent, or Firm*—Keaty Professional Law Corporation

(57) ABSTRACT

A self-elevating drilling unit has dual cantilever assemblies that move longitudinally and transversely in relation to the jack-up platform to allow drilling operation to be performed from two drilling floors. The twin cantilever assemblies permit simultaneous drilling on an 8 feet×8 feet spacing. The cantilever assemblies are retained attached to the platform by a hold down beam that extends over and across the cantilever assemblies. The hold down beam is positioned in a stationary manner on the platform deck. A movable strut that engages the underside of the hold down beam moves along the beam to counteract upward bending forces acting on the beam when the cantilever assemblies are extended from the platform. The cantilever assemblies are made of tubular truss work and can be moved to an infinite number of horizontal positions.

31 Claims, 8 Drawing Sheets

SELF-ELEVATING DRILLING UNIT

BACKGROUND OF THE INVENTION

The present invention relates to an oil and gas industry, and more particularly to a drilling jack-up platform that can be used to develop sub-salt gas wells through existing shallow wells or to drill entirely new wells.

In the past, a large number of fixed platforms have been used in the oil and gas industry for exploration and production of natural resources. The wells were drilled and pipelines laid for connection to the wells to extract the valuable hydrocarbon fuel from offshore locations, often at a considerable cost to the developer. Some of these platforms and pipelines are quite old; they were designed for small platform rigs that can support drilling operations at 8,000–20,000 feet. However, these old platforms cannot simultaneously support exploration and production from the high-pressure deep formations of the sub-salt environment.

In order to continue drilling and production using the existing wells, additional process equipment is required for pre-treating of the produced fluids while utilizing the existing process train. If such equipment is to be installed on the old platforms, it will utilize any remaining topsides capacity of these platforms.

The present invention was conceived to assist the platform owners to continue exploration and production from the existing fixed platforms, while providing support for the necessary drilling equipment and consumables independently of the fixed platform. The present invention utilizes a jack-up design with a cantilever drill floor that extends over the fixed platform with existing wells to support deeper drilling and stimulate production from the old wells.

The use of cantilevers on drill platforms is not entirely new. One of the known jack-up platforms utilizing cantilever is disclosed in U.S. Pat. No. 6,171,027 issued on Jan. 9, 2001 for "Cantilevered Jack-Up Platform." According to this patent, one cantilever is provided on a jack-up platform. The cantilever moves in a longitudinal direction, towards and away from the platform, as well as in a transverse direction. A drilling platform, from which the drilling operations are performed, along with the derrick, and other drilling equipment, is fixedly positioned on the cantilever. It moves along with the cantilever longitudinally and transversely. The cantilever is supported by supporting members which slide by means of cylinders over rails that are provided on the jack-up platform.

While this design is an improvement over old cantilever designs, there is still a limit to the number of wells that can be drilled with the use of the drilling equipment positioned on the platform according to the '027 patent. However, by using only one cantilever assembly and one drilling floor, the design of the '027 patent does not permit conducting very efficient drilling operations.

The present invention contemplates elimination of drawbacks associated with the prior art and provision of a self-elevating drilling jack-up platform that can be positioned adjacent to existing platforms, as well as in undeveloped locations to support drilling and recompletion operations down to 25,000–35,000 feet from dual cantilever drilling assemblies. Primary among the improvements over the prior art is the fact that two drilling cantilevers are provided on the jack-up unit, allowing for much faster well development. Further, one of the advances that makes having two cantilevers viable is the use of a truss structure for the cantilever. This has led to weight savings that have kept the reaction forces imparted by the cantilever onto the jack-up manageable by a typically sized jack-up hull. Also, the cantilevers are infinitely adjustable within their extreme limits of motion in the horizontal plane. Also, the slim geometry of each cantilever will allow it to work over platforms in deeper water than a unit of similar leg length having a broader cantilever. This is because the slim cantilever can fit between the process equipment module and quarter's module of a fixed platform and be just above a well bay. A broader cantilever could be forced to reach from high above the well bay.

SUMMARY OF THE INVENTION

It is, therefore, an object of the present invention to provide a self-elevating drilling unit that can be used for completing wells in deep salt areas.

It is another object of the present invention to provide a jack-up platform that uses twin cantilevers extendable from the aft of the platform, while being held down on the platform by a stationary hold down beam.

It is a further object of the present invention to provide a jack-up drilling platform wherein twin cantilever structures move independently relative to the platform in a longitudinal direction, extending outwardly from the platform, and in a transverse direction, perpendicular to the first direction.

These and other objects of the present invention are achieved through a provision of a jack-up platform that is positionable adjacent an existing stationary platform at an offshore location. A pair of cantilever assemblies are mounted on the jack-up platform and are secured at one of their ends to the jack-up platform by a hold down beam that extends over and across the cantilever assemblies. Each cantilever assembly supports drilling and production operations, as necessary, while capable of performing simultaneous drilling operations on an 8 feet×8 feet well spacing, if necessary.

The cantilever assemblies slide on lower longitudinal and transverse roller assemblies that are positioned on a deck of the jack-up platform. Upper longitudinal and transverse roller assemblies are mounted between the upper surfaces of the cantilevers beams and the hold down beam. The upper roller assemblies allow the cantilever beams to slide in relation to the hold down beam, while being retained in a secure relation to the jack-up platform.

A movable strut engages the deck of the jack-up hull and the hold down beam and slides on rollers in relation to the hold down beam. A lower end of the strut is guided by a bracket mounted on a deck of the jack-up platform. The strut engages the hold down beam and deck when the cantilever assemblies are extended to decrease the deflection of the hold down beam.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
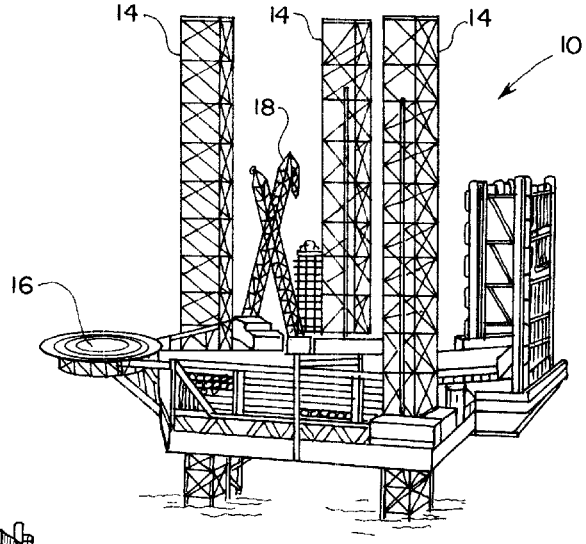
FIG. 1 is a perspective view of the self-elevating drilling unit in accordance with the present invention.

Turning now to the drawings in more detail, numeral 10 designates the self-elevating jack-up drilling unit in accordance with the present invention. The unit 10 comprises an elevating hull 12, which can be of a generally triangular configuration or other configuration, if desired. The platform hull is supported by and is moveable in relation to a plurality of supporting legs 14 that support the platform at roughly the geometric corners of the hull.

Conventionally, the unit 10 is floated to the deployment site with the legs fully extended above the hull, and, once it reaches the site of the expected operations, and the legs are lowered and possibly embedded in the floor of the ocean, the platform hull is raised to the operational draft by a system of jacks.

The platform hull 12 is designed to support the drilling equipment, storage operational consumables and accommodate living quarters of the crew. These facilities are positioned on different decks of the hull 12 to fully maximize the space afforded by the structure for storage of the tubular goods on the open areas of the decks and cantilevers.

The unit 10 can be also provided with a heliport 16 and a number of cranes 18 for lifting of the loads on the platform. The main deck 28 is shown in more detail in FIGS. 4, 5, and 6.

The main deck 28 conventionally supports various equipment, such as anchor winches 22, anchor buoys 24, stores 26, and other mechanical and electrical equipment for conducting drilling and production operations at sea. A pair of cantilever assemblies 30 and 32 are positioned on the deck 28 in a parallel relationship to each other. The cantilever assemblies 30 and 32 are independently movable in relation to each other and function independently, as will be described in more detail below.

The cantilever assemblies 30, 32 are designed to house some of the drilling equipment that is integral to the drilling process, mud processing equipment, shale shakers, and solids control of the mud system. Diesel driven cementing equipment is provided in each of the cantilever assemblies to control the wells in case of an emergency. The hydraulic control for the blow preventer is located on each cantilever. The cantilever assemblies 30 and 32 share reserve mud pits, primary mud pumps and main power (not shown) that are positioned within the hull 12 to supply the mud for the well drilling.

Figure 12:
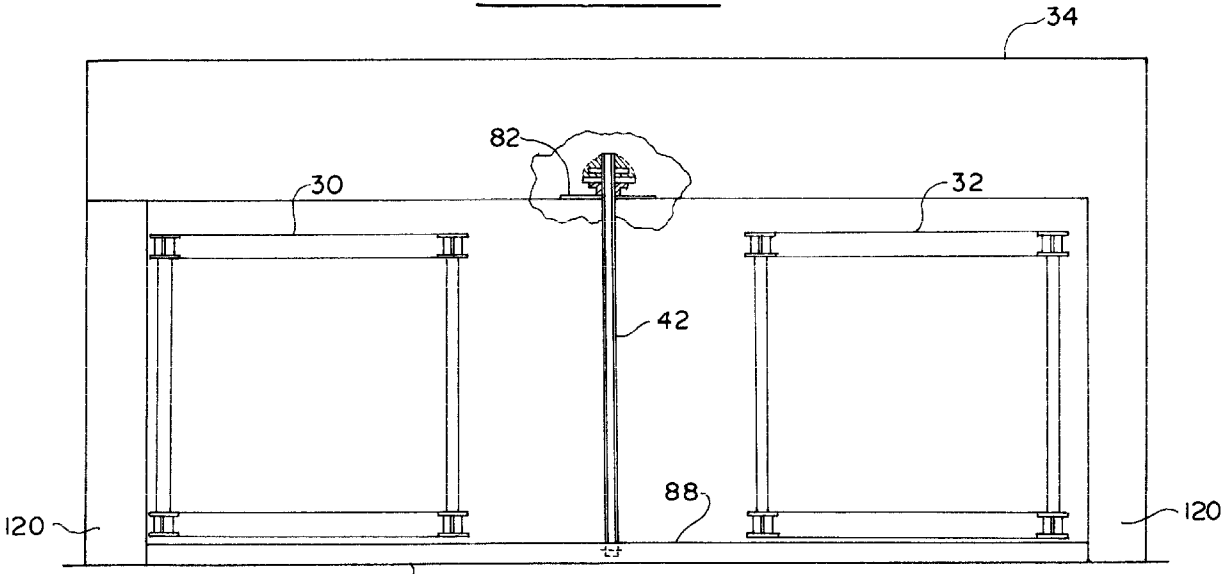
FIG. 12 is a detail view showing a longitudinal section of a beam taken at a 90-degree angle in relation to the view of FIG. 9.

In the past, cantilevers were tied down to the elevating hull 12 by structure from below the cantilever beams. In the present invention, the cantilevers are held down by a transverse beam 34 that spans the distance above the cantilever assemblies 30 and 32 and is fixed to the hull 12 beyond the transverse extremes of the cantilever assemblies 30 and 32. The hold down beam 34 has a generally inverted U-shaped configuration (FIG. 12).

Figure 3:
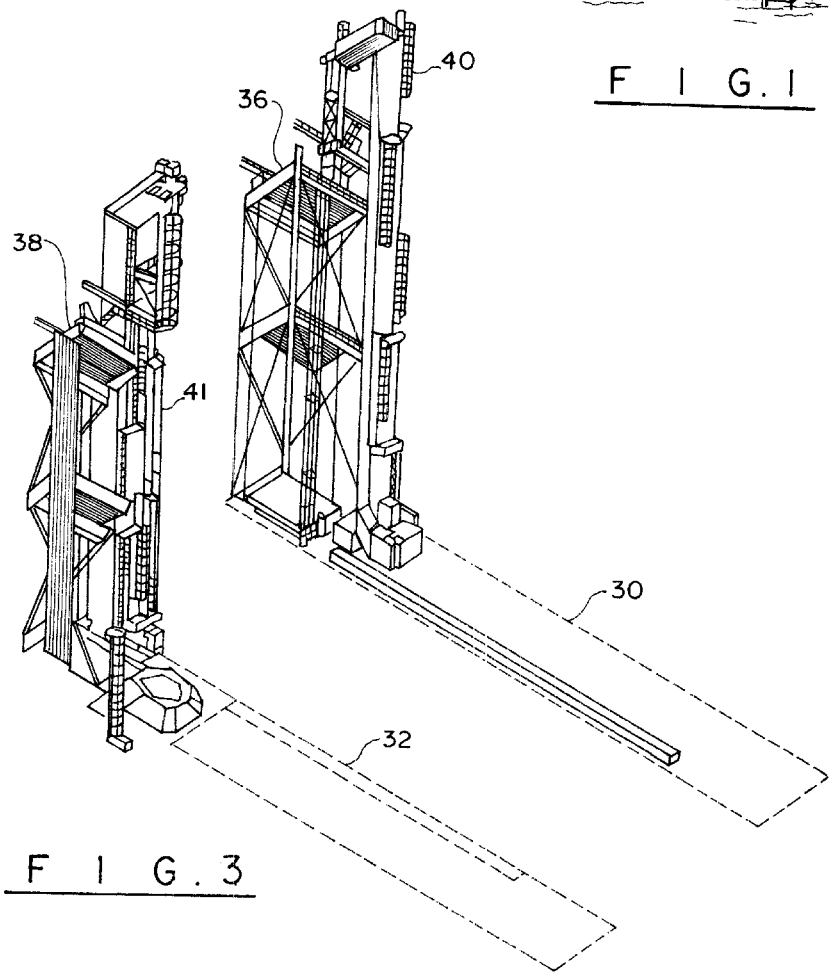
FIG. 3 is a detail perspective view showing two cantilever assemblies with individual masts for use in the apparatus of the present invention.
Figure 2:
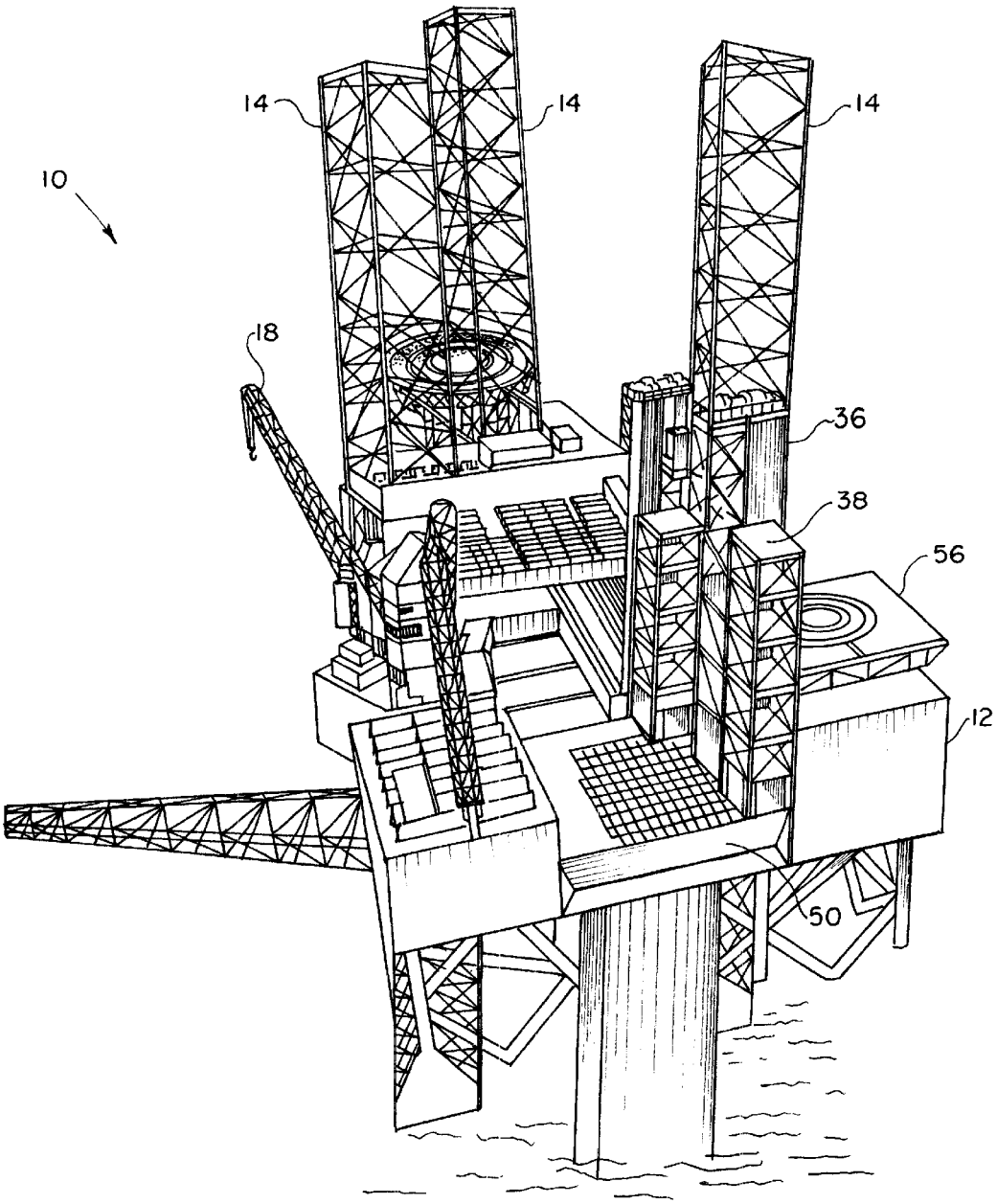
FIG. 2 is a perspective view of the aft section of the jack-up rig of the present invention, with cantilever assemblies extending over a fixed platform.

The hold down beam 34 is supported at both lower ends and is tightened back to the deck structure 20. Additionally, the hold down beam 34 is supported by a moveable strut that moves across the length of the beam between the cantilever assemblies 30 and 32 to reduce the span of the hold down beam 34 and transfer the loads back down into the hull 12. Each cantilever assembly 30 and 32 is provided with its own mast 36, 38, respectively, as well as derricks 40, 41 respectively (FIG. 3).

An existing fixed platform 50 serves as a grid, over which the cantilever assemblies 30 and 32 are extended. The fixed platform 50 remains at some distance from the platform 10, such that a gap 52 exists between the two structures. The fixed platform 50 may have a grid of potentially usable wells 54 connected by pipelines to the hull 56 of the fixed platform 50. The platform 50 is usually an existing platform that was used to support drilling and production operations at 8,000–20,000 feet.

The present invention contemplates utilizing the existing well structure to complete the wells to a drilling depth up to 25,000–35,000 feet. Since the fixed platform is relatively small, considering that it did not have to support deep drilling operations, it is not capable of providing the infrastructure necessary for deep drilling.

The present invention contemplates the use of the platform 10 while exploiting the wells 54 that remain on the old platform and were used for the production and exploration at relatively shallow levels. By using two cantilever assemblies that move independently over the wellheads 54, the present invention saves about 40% of the time that it takes to normally drill these wells with a conventional jack-up unit.

Two simultaneously performed drilling operations allow to complete the wells quicker and get them online in a much shorter period of time than would be possible with conventional equipment. Since only one jack-up unit 10 is needed to double the drilling operations, the cost of bringing the unit to a location, loading the jack-up, and bringing it to the operational condition can be considerably reduced.

The number of wells on existing platforms can be anywhere between 12 and 48. The present invention allows to perform drilling operations in an 8 feet by 8 feet grid with a wellhead being in the center. By using two independently mobile cantilever assemblies, the number of wells that can be drilled to a deeper depth can be doubled, with the same cost of the jack-up rig equipment.

While the rig 10 is positioned next to the existing platform 50, no weight is transferred between,the platform 10 and the platform 50. The cantilevers are counterweighted from the deck of the platform 10 that supports the cantilever assemblies 30 and 32 entirely.

The only weight that is placed on the existing platform 50 is the weight of a blowout preventor that is placed on the existing wellhead to perform the drilling. At the same time, the drilling assemblies positioned on the cantilever assemblies 30 and 32 can perform new drilling operations to a full depth of 35,000 feet, if necessary. Theoretically, two wells can be drilled within 8 feet of each other without interrupting the drilling operation from one or the other of the cantilever.

Figure 4:
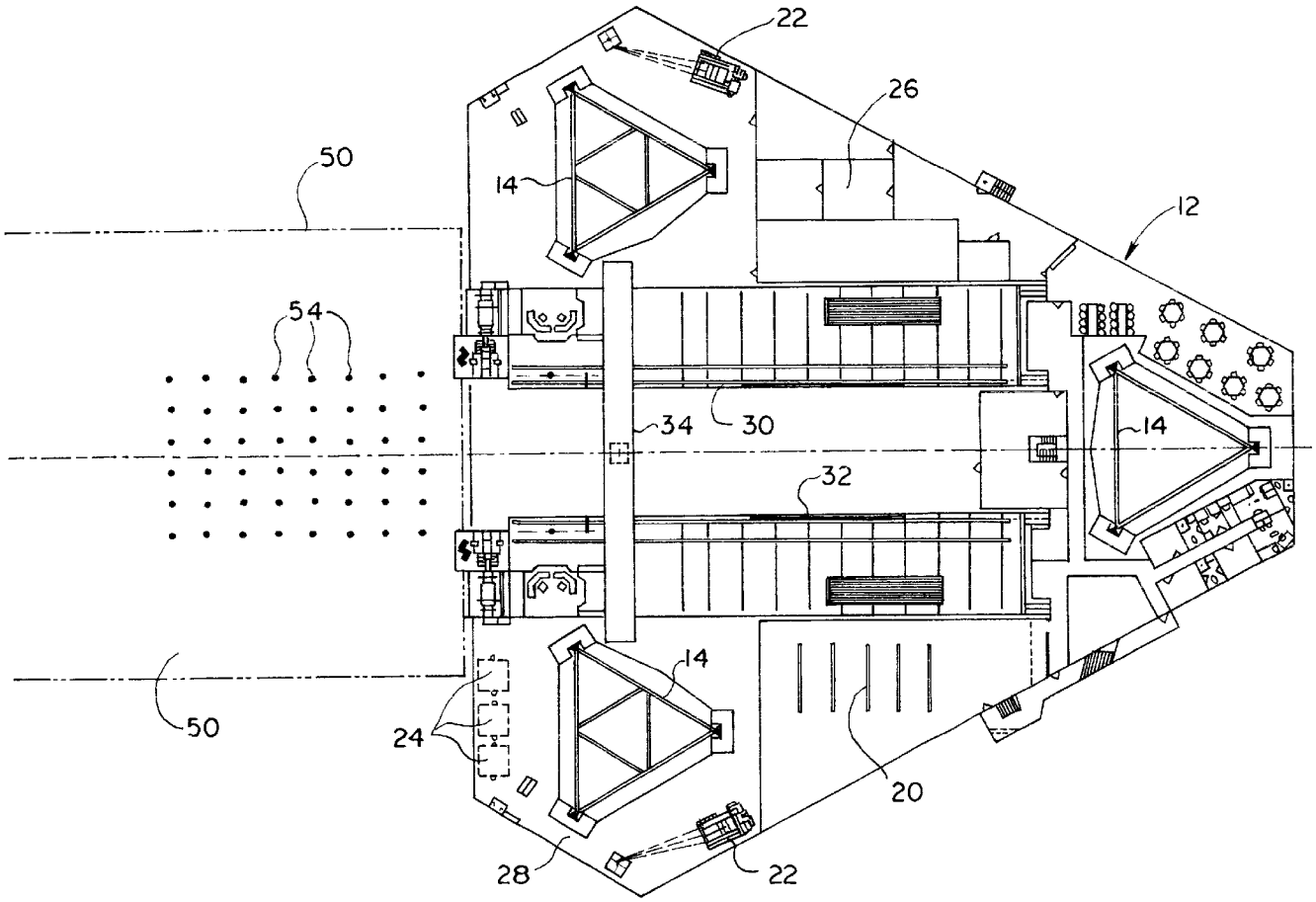
FIG. 4 is a top plan view of the drilling unit in accordance with the present invention, with the cantilever assemblies stored on the platform.
Figure 5:
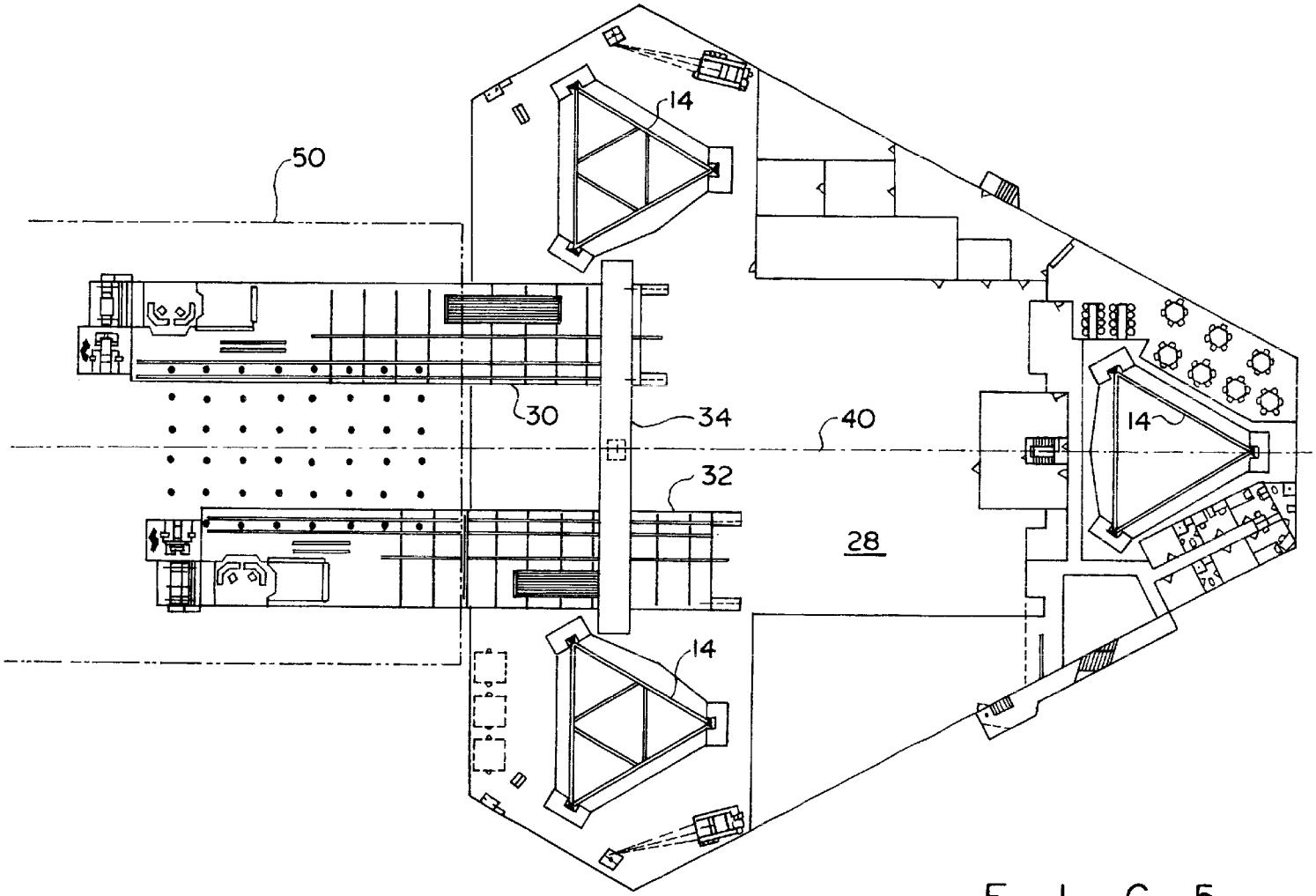
FIG. 5 is a plan view of the jack-up unit in accordance with the present invention, with both cantilever assemblies extended independently over the drilling area, longitudinally away from the platform.
Figure 6:
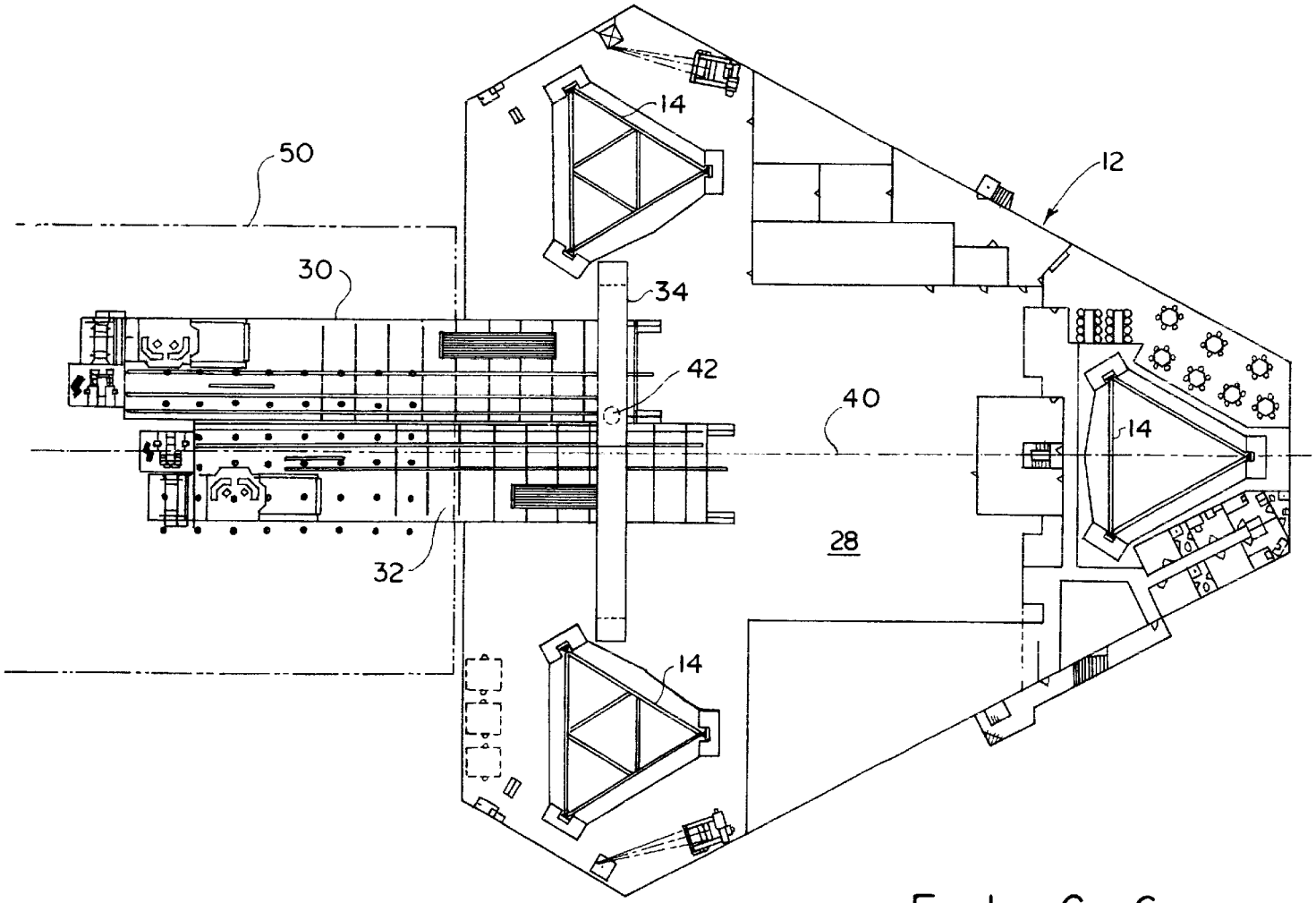
FIG. 6 is a view showing transverse movement of the cantilever assemblies in relation to a central axis of the drilling platform.
Figure 7:
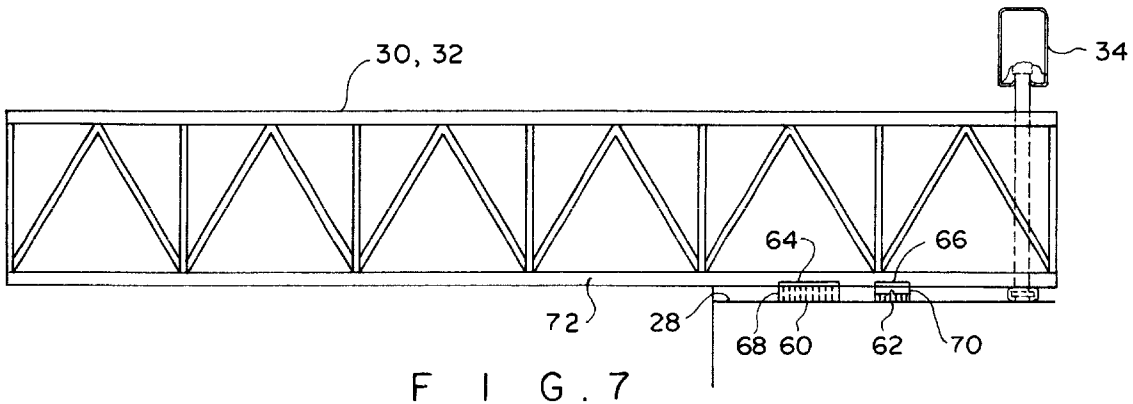
FIG. 7 is a detail side view of one of the cantilever beams showing the truss structure of the beam and the lower rollers for moving the beams longitudinally and transversely.

Turning now in more detail to FIGS. 4, 5, and 6, the movement of the cantilever assemblies 30 and 32 longitudinally and transversely will be discussed. FIG. 4 illustrates the cantilever assemblies 30 and 32 in their stored position, fully retracted to the deck 28. FIG. 5 illustrates longitudinal extension of the cantilever assemblies 30 and 32 above the fixed platform 50. In this position, or any other "y" extension, the cantilever assemblies move along the "x" axis.

Since the assemblies 30 and 32 move independently, the port cantilever assembly 30 can extend further from the deck 28, while the starboard cantilever assembly 32 can extend to a smaller distance from the deck 28 to perform drilling operations at a different location in relation to the wells 54 to the platform 50. The cantilever assemblies 30 and 32 are held in place by the stationary hold down beam 34, which extends above the cantilever assemblies 30 and 32 and is fixedly connected to the deck structure 28.

FIG. 6 illustrates transverse movement of the cantilever assemblies 30 and 32 in relation to the central axis 40 of the hull 12, or along the axis "y." As can be seen in FIG. 6, the port cantilever assembly 30 was moved closer to the centerline 40, and the starboard cantilever assembly 32 moved transversely to the centerline 40, next to the port cantilever assembly 30. To prevent bending of the hold down beam 34, a moveable strut 42 is provided. The strut 42, while guided from the deck 28, moves below the hold down beam 34, as will be described in more detail hereinafter. The strut 42 is always positioned between the two cantilever assemblies 30 and 32.

The cantilever assemblies 30, 32 are configured as truss work structures and not box plate structures. This considerably reduces the weight of the cantilever beams and consequently allows to reduce the reaction forces imparted to the hold-down beam and stem of the jack-up enough so as to make the presence of two cantilevers viable for a typically sized jack-up hull. The truss work uses narrow tubular braces, as opposed to solid metal plates. The cantilever beams are still structurally strong to support the necessary working equipment and withstand the loads when the cantilever assemblies, manufactured and configured from tubular trusses, are extended to their maximum extension distance from the platform 12.

To facilitate movement of the cantilever assemblies 30 and 32, the present invention utilizes lower longitudinal rollers 60 and lower transverse rollers 62. The roller assemblies rest on the deck 20 and are kept below the cantilever beams by "keeper plates" 64 and 66, respectively. The keeper plates 64 and 66 are fixedly attached to the roller assembly frames 68, 70. A lower cantilever beam 72 (only one is shown) engages the keeper plates 64, 66, allowing movement of the assemblies 30 and 32 longitudinally, away from the platform 12 and transversely, from port to starboard side of the platform 12, as required.

Turning now to FIGS. 8–11, the hold down beam 34 and the moveable strut 42 are shown in more detail. The hold down beam 34 spans transversely between the cantilever assemblies 30 and 32, which assemblies slide in relation to the beam 34 with the help of the upper longitudinal roller assembly 80 and upper transverse roller assembly 118. The roller assembly 80 allows longitudinal travel of the assemblies 30, 32.

Figure 8:
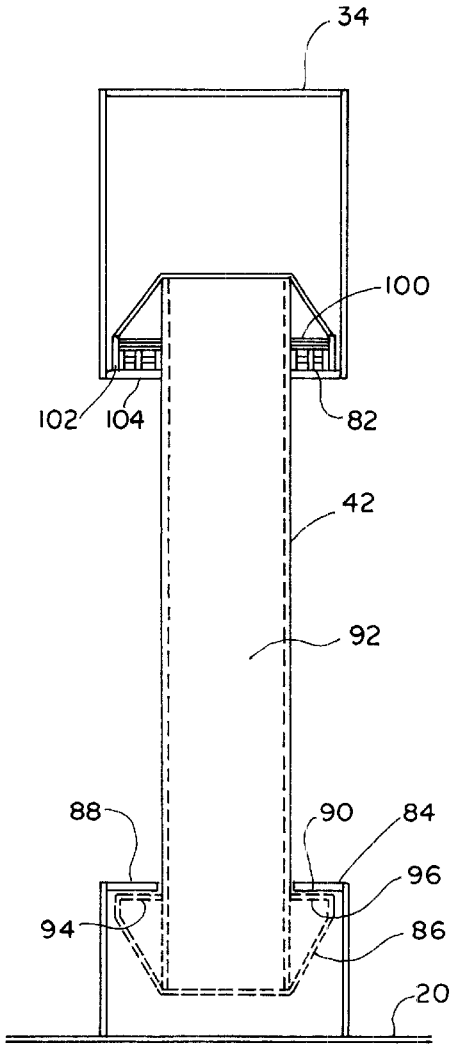
FIG. 8 is a detail view showing a longitudinal section through a hold-down beam and moveable strut.

The strut 42 moves transversely, below the hold down beam 34, with the help of strut roller assemblies 82 (FIG. 8). A hold down claw, or bracket 84 serves as a guide for a lower portion 86 of the strut 42. The guiding bracket 84 is mounted on the deck 20 and is provided with inwardly facing flanges 88, 90 that extend towards the vertical body 92 of the strut 42. The lower portion 86 of the strut 42 has outwardly horizontally extending plates 94, 96 that serve as an anchor that abuts the portions 88 and 90, while preventing disengagement of the strut body 92 from the guiding hold down claw 84.

The strut moves transversely in relation to the cantilever assemblies 30 and 32, while still being in contact with the hold down beam 34 and the deck 20 through the hold down claw, or bracket 84.

During operation and movement of the cantilever assemblies 30, 32, the beam 34 tends to bend while holding the cantilever assemblies down. By moving the strut 42 in relation to the hold down beam 34, the bending forces tending to act on the hold down beam 34 can be substantially reduced by reducing the shoulder, or the distance that is created during movement of the cantilever assembly.

For instance, if the strut 42 is positioned in the center below the beam 34, the effective span can be divided by half. Depending on the degree of longitudinal extension of the cantilever beams from the hull 12, the strut 42 can be moved toward or away from the cantilever assembly. The strut 42 reacts the upward load acting on the hold down beam 34 during extension of the cantilever assemblies 30 and 32 and thereby reduces the bending of beam 34.

To prevent bending of the inwardly facing portions of the beam 34, the strut 42 is provided with rollers 82. The strut rollers 82 are provided with soft compressible pads 100 on top of the roller assemblies 82. When the hold down beam is stressed and tends to bend, a hard bearing surface 102 that extends on the sides of the rollers 82 moves down until it contacts the inwardly facing portions 104 of the hold down beam 34. The compressible pads 100 are compressed, to some degree, by the hold down beam, but further bending of the beam 34 is prevented when the hard bearing surface 102 bears against the inwardly facing portions 104.

Figure 9:
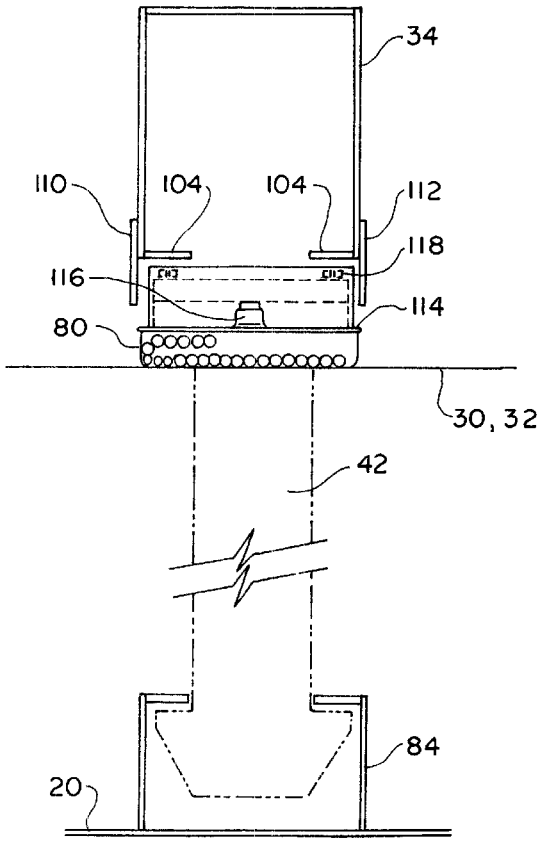
FIG. 9 is a detail view showing a longitudinal section through a hold-down beam, along with the upper longitudinal and transverse rollers, when the cantilever assemblies are in a stowed position.

Turning now to FIG. 9, the hold down beam is illustrated at a section taken along the beam away from the strut 42. The hold down beam 34 carries a pair of keeper plates 110, 112 welded to the outside of the beam 34. The upper longitudinal roller assembly 80 has a top plate 114 that supports a hydraulic jack 116 thereon. FIG. 9 shows a retracted hydraulic jack when the cantilever assembly is in a store position and no bending forces are present. There is no metal-to-metal contact between the inwardly facing flanges 104 and the upper transverse rollers 118 in this case.

When the cantilever assemblies 30, 32 extend outwardly in a longitudinal direction, a considerable stress is placed on the hold down beam 34. The hydraulic jack 116 is still retracted. The design of the present invention causes the cantilever assemblies 30, 32 to tip up at the front such that there is a metal-to-metal contact between the portions 104 of beam 34 and the top of the upper transverse roller assemblies 118.

Figure 11:
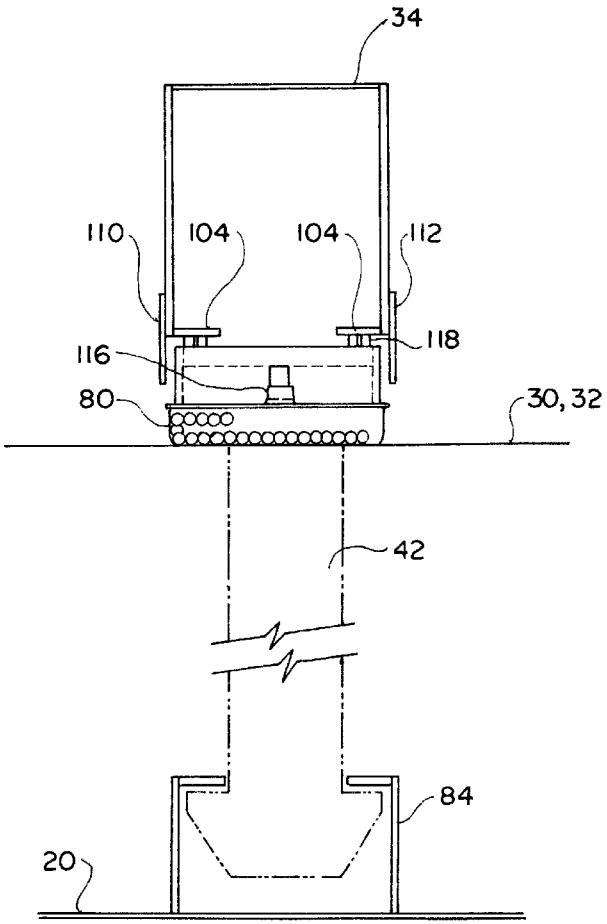
FIG. 11 is a detail view showing a longitudinal section through a hold-down beam, along with the upper longitudinal and transverse rollers, when the cantilever assemblies are ready for a transverse travel.
Figure 10:
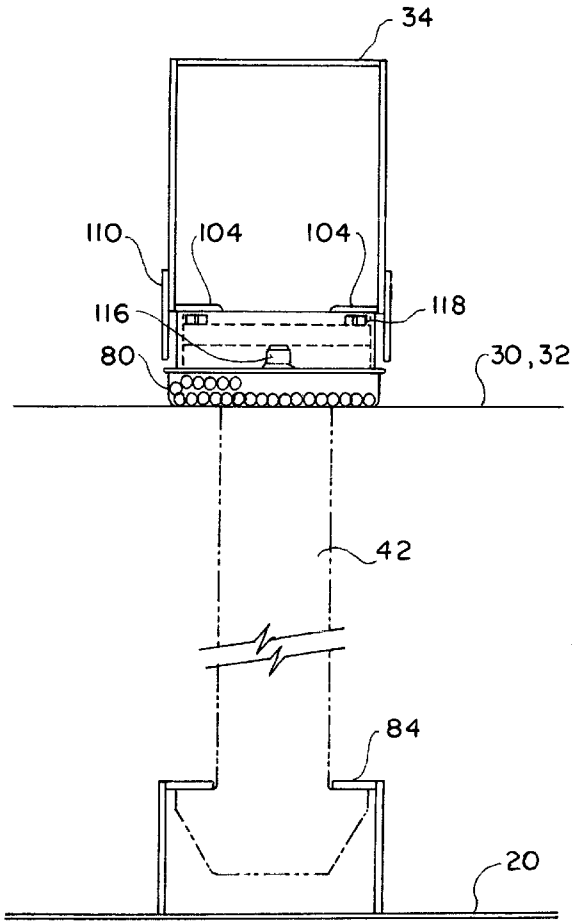
FIG. 10 is a detail view showing a longitudinal section through a hold-down beam, along with the upper longitudinal and transverse rollers, when the cantilever assemblies are in an extended position.

FIG. 11 illustrates position of the hold down beam 34 when the cantilevers assemblies are ready for transverse travel. In this case, the jack 116 is activated, telescopically extending and tipping the fore of the cantilever assemblies 30,32 downward. The upper transverse roller assemblies 118 can now be placed into activation and allow rolling of the cantilever assemblies 30, 32 in a transverse direction, while the beam 34 remains stationary.

Shown in FIG. 12 is a front view of the hold down beam 34 with a pair of cantilever assemblies 30 and 32 positioned underneath the hold down beam 34. For clarity, the roller assemblies 80 have been removed. The strut 42 is seen extending through the center of the hold down beam 34. As described above, the strut 42 is moveable in the direction of port and starboard of the rig 10 to counteract the bending forces acting on the hold down beam 34.

The lower ends 120, 122 of the hold down beam 34 are secured to the top of the hold down claw 84 which, in turn, is fixedly secured to the deck 20. Therefore, the hold down beam 34 is stationary in relation to that deck 20, while the beam assemblies 30 and 32, as well as the strut 42 are moveable.

The strut 42 efficiently transfers the load from the hold down beam 34 back down to the hull of the vessel. The strut 42 being moveable, assists in counterbalancing the extended weight of the cantilever beams anywhere on the x-y grid along which the cantilever assemblies 30, 32 move. The jack 116 that rides on the cantilever beams 30 and 32 serves the purpose of engaging the lower transverse rollers on the main deck (when jack is extended) or disengaging same (when jack is retracted) once the desired transverse position of the cantilever assembly is obtained.

The design of the present invention allows a twin drilling facility fitted on a jack-up rig to support simultaneous drilling of two wells. The cantilever assemblies 30 and 32 are composed of tubular trusses to reduce the weight of the cantilevers and to allow a typical jack-up to support the weight and loads associated with the drilling of two wells simultaneously. The drilling systems are designed to function independently and to accommodate both the high pressure and high temperature problems associated with sub salt wells.

The cantilever/drilling facilities of the present invention are designed to function with the high technology drilling systems that can be provided by automated drilling system manufacturers or a drilling system that could be packaged by the owners of the drilling unit, if desired. The mud process and well control is located on each cantilever beam to function independently and providing an extra degree of autonomy and safety to the drill well activities.

The cantilever and drilling facilities of the present invention can cover a 75-foot by 40-foot well pattern on a typical 8 foot×8 foot spacing. The system of the present invention is capable of reducing the time required to drill and complete the wells of a platform by as much as 40% without having to reinforce or relocate the host platform.

The rig 10 is not limited in its use for only developing existing wells in cooperation with existing fixed platforms. The unit 10 can be successfully used for new explorations and production operations if necessary.

Many changes and modifications can be made in the design of the present invention without departing from the spirit thereof. We therefore pray that our rights to the present invention can be limited only by the scope of the appended claims.

We claim:

1. A self-elevating drilling unit for offshore operations, comprising:

a jack-up platform having a deck structure and a central axis extending from front to aft of the platform;

a pair of cantilever assemblies supported by the platform, each of said cantilever assemblies independently movable in a first direction substantially parallel to the central axis of the platform and a second direction substantially perpendicular to the first direction; and a means for securing said cantilever assemblies on the platform, said securing means extending above said cantilever assemblies, said securing means engaging the deck structure of said platform.

2. The apparatus of claim 1, wherein said cantilever assemblies are capable of supporting simultaneous drilling operations performed independently from each cantilever assembly.

3. The apparatus of claim 1, wherein each of said cantilever assemblies is configured to support drilling of wells in high pressure and high temperature environment.

4. The apparatus of claim 1, wherein the cantilever assemblies are movable to support drilling operations on an 8 feet×8 feet spacing.

5. The apparatus of claim 1, wherein each of said cantilever assemblies is made of tubular trusses to decrease loads acting on the cantilever assemblies and the platform when the cantilever assemblies are extended away from the platform.

6. The apparatus of claim 1, wherein each of said cantilever assemblies is supported by and slides upon lower roller assemblies adapted for longitudinal and transverse travel.

7. The apparatus of claim 6, wherein said lower roller assemblies comprise longitudinal lower roller assemblies and lower transverse roller assemblies.

8. The apparatus of claim 7, wherein each of said lower roller assemblies comprises a roller frame and a retaining plate, said retaining plate retaining said roller assembly under a corresponding cantilever assembly.

9. The apparatus of claim 8, wherein said roller assemblies rest on a deck of the platform.

10. The apparatus of claim 1, wherein said securing means comprises a hold down beam extending above said cantilever assemblies in a transverse relationship to the cantilever assemblies.

11. The apparatus of claim 10, further comprising upper longitudinal roller assemblies and upper transverse roller assemblies to facilitate movement of said cantilever assemblies in relation to said hold down beam.

12. The apparatus of claim 11, wherein upper longitudinal and upper transverse roller assemblies are positioned between a top surface of said cantilever assemblies and said hold down beam to allow sliding movement of said cantilever assemblies in relation to said hold down beam.

13. The apparatus of claim 11, further comprising a movable strut positioned in a sliding relation to said hold down beam, said strut reducing upward bending forces acting on said hold down beam when said cantilever assemblies are extended.

14. The apparatus of claim 13, further comprising strut roller assemblies positioned between a bottom of said hold down beam and said strut to allow movement of said strut along said hold down beam.

15. The apparatus of claim 13, further comprising a retainer bracket for engaging a lower end of said strut, said retainer bracket being fixedly attached to a deck of the platform, said retainer bracket guiding said strut in the movement below said hold down beam.

16. The apparatus of claim 1, wherein said cantilever assemblies are moveable to an infinite number of adjustable horizontal positions within limits of travel in relation to the jack-up platform.

17. A self-elevating drilling unit for offshore operations, comprising:

a jack-up platform having a central axis extending from front to aft of the platform;

a pair of cantilever assemblies supported by the platform, each of said cantilever assemblies independently movable in a first direction substantially parallel to the central axis of the platform and a second direction substantially perpendicular to the first direction; and a means for securing said cantilever assemblies on the platform, said securing means extending above said cantilever assemblies, said securing means being fixedly connected to said platform and comprising a hold down beam having an inverted U-shape configuration, opposite legs of said hold down beam being fixedly attached to a deck of said platform.

18. The apparatus of claim 17, wherein said cantilever assemblies are capable of supporting simultaneous drilling operations performed independently from each cantilever assembly on an 8 feet×8 feet spacing.

19. The apparatus of claim 17, wherein each of said cantilever assemblies is supported by and slides upon lower roller assemblies adapted for longitudinal and transverse travel, said lower roller assemblies comprising longitudinal lower roller assemblies and transverse lower roller assemblies.

20. The apparatus of claim 17, further comprising upper longitudinal roller assemblies and upper transverse roller assemblies to facilitate movement of said cantilever assemblies in relation to said hold down beam, said upper longitudinal and upper transverse roller assemblies being mounted between a top surface of said cantilever assemblies and said hold down beam to allow sliding movement of said cantilever assemblies in relation to said hold down beam.

21. The apparatus of claim 17, further comprising a movable strut positioned in a sliding relation to said hold down beam, said strut reducing upward bending forces acting on said hold down beam when said cantilever assemblies are extended.

22. The apparatus of claim 21, further comprising strut roller assemblies positioned between a bottom of said hold down beam and said strut to allow movement of said strut along said hold down beam.

23. The apparatus of claim 21, further comprising a retainer bracket for engaging a lower end of said strut, said retainer bracket being fixedly attached to a deck of the platform, said retainer bracket guiding said strut in the movement below said hold down beam.

24. The apparatus of claim 17, wherein movement of said cantilever assemblies is infinitely adjustable within a horizontal plane within limits of travel of said cantilever assemblies in relation to the jack-up platform.

25. A self-elevating drilling unit for conducting offshore operations, while utilizing well heads of an existing stationary platform, comprising:

a jack-up platform having a deck structure and positionable adjacent the existing stationary platform;

a pair of cantilever assemblies supported by the jack-up platform, each of said cantilever assemblies independently movable in a first direction longitudinally toward and away from the jack-up platform over the well heads of the stationary platform and a second direction substantially perpendicular to the first direction; and a means for securing said cantilever assemblies on the jack-up platform, said securing means extending above said cantilever assemblies, said securing means engaging the deck structure of the jack-up platform.

26. The apparatus of claim 25, wherein said securing means is fixedly connected to said platform and comprises a hold down beam having an inverted U-shape configuration, opposite legs of said hold down beam being fixedly attached to a deck of said jack-up platform.

27. The apparatus of claim 26, further comprising upper longitudinal roller assemblies and upper transverse roller assemblies to facilitate movement of said cantilever assemblies in relation to said hold down beam, said upper longitudinal and upper transverse roller assemblies being mounted between a top surface of said cantilever assemblies and said hold down beam to allow sliding movement of said cantilever assemblies in relation to said hold down beam.

28. The apparatus of claim 26, further comprising a movable strut positioned in a sliding relation to said hold down beam, said strut reducing upward bending forces acting on said hold down beam when said cantilever assemblies are extended.

29. The apparatus of claim 28, further comprising strut roller assemblies positioned between a bottom of said hold down beam and said strut to allow movement of said strut along said hold down beam.

30. The apparatus of claim 28, further comprising a retainer bracket for engaging a lower end of said movable strut, said retainer bracket being fixedly attached to a deck of the platform, said retainer bracket guiding said movable strut in the movement below said hold down beam.

31. The apparatus of claim 25, wherein each of said cantilever assemblies is supported by and slides upon lower roller assemblies adapted for longitudinal and transverse travel, said lower roller assemblies comprising longitudinal lower roller assemblies and transverse lower roller assemblies.

* * * * *